US012286842B2

(12) United States Patent
Hammargren

(10) Patent No.: US 12,286,842 B2
(45) Date of Patent: Apr. 29, 2025

(54) THREAD PITCH

(71) Applicant: SANDVIK MINING AND CONSTRUCTION TOOLS AB, Sandviken (SE)

(72) Inventor: John Hammargren, Sandviken (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 0 days.

(21) Appl. No.: 18/710,854

(22) PCT Filed: Nov. 16, 2022

(86) PCT No.: PCT/EP2022/082078
§ 371 (c)(1),
(2) Date: May 16, 2024

(87) PCT Pub. No.: WO2023/088939
PCT Pub. Date: May 25, 2023

(65) Prior Publication Data

US 2024/0426179 A1 Dec. 26, 2024

(30) Foreign Application Priority Data

Nov. 19, 2021 (EP) ..... 21209361

(51) Int. Cl.
*E21B 17/042* (2006.01)
*E21B 10/36* (2006.01)

(52) U.S. Cl.
CPC ..... *E21B 17/0426* (2013.01); *E21B 10/36* (2013.01)

(58) Field of Classification Search
CPC ..... E21B 17/0426; E21B 10/36
See application file for complete search history.

(56) References Cited

U.S. PATENT DOCUMENTS 1,733,392 A * 10/1929 Barra ..... E21B 17/0426 411/929
4,084,829 A * 4/1978 Falchle ..... B25D 17/08 173/104
4,332,502 A 6/1982 Wormald et al.
4,398,756 A 8/1983 Duret et al.
(Continued)

FOREIGN PATENT DOCUMENTS

DE 2800887 A1 7/1978

*Primary Examiner* — D. Andrews
(74) *Attorney, Agent, or Firm* — Corinne R. Gorski

(57) ABSTRACT

A female portion arranged to form part of a thread joint for a percussive drilling tool includes a mounting sleeve, wherein the mounting sleeve has at least one substantially cylindrical internally threaded section having a length, $L_1$, a thread entrance located towards an axial end and a thread exit located towards the axial inner wall. The threaded section has a thread form including crests, roots, contact flanks, and non-contact flanks, a pitch length, $L_4$, located between two axially neighboring crests and an inner diameter, $D_2$ disposed radially between the roots. A thread clearance section is positioned between the axial inner wall and the thread exit and has a length $L_2$ and a diameter $D_1$. A guiding section is positioned between the thread entrance and the axial end of the sleeve and has a length, $L_3$. The pitch length, $L_4$, is between 12.8-14.5 mm.

13 Claims, 8 Drawing Sheets

(56) References Cited

U.S. PATENT DOCUMENTS

| | | | | |
|---|---|---|---|---|
| 4,687,368 | A | 8/1987 | Eklof et al. | |
| 4,968,068 | A * | 11/1990 | Larsson | E21B 17/0426 29/434 |
| 6,293,360 | B1 * | 9/2001 | Liljebrand | E21B 17/0426 175/320 |
| 6,767,156 | B1 * | 7/2004 | Larsson | E21B 17/0426 403/343 |
| 2001/0026069 | A1 | 10/2001 | Linden | |
| 2020/0248510 | A1 | 8/2020 | Yai | |
| 2020/0408048 | A1 | 12/2020 | Hamargren et al. | |
| 2021/0047889 | A1 | 2/2021 | Rindeskar | |

* cited by examiner

THREAD PITCH

RELATED APPLICATION DATA

This application is a § 371 National Stage Application of PCT International Application No. PCT/EP2022/082078 filed Nov. 16, 2022 with priority to EP 21209361.1 filed Nov. 19, 2021.

TECHNICAL FIELD

The present invention relates to a female portion to form part of a thread joint for a percussive drilling tool, especially for, although not exclusively for drill bits and drill rods.

BACKGROUND

Percussion drilling is used to create a long borehole via a plurality of elongate drill string rods coupled together end-to-end by interconnected male and female threads. Alternatively, a drill bit may be connected to a single rod. The well-established technique breaks rock by hammering impacts transferred from the rock drill bit to the rock at the bottom of the borehole. The rock drill bit is mounted at one end of the drill string via a male thread on the endmost drill string rod to a female thread on the drill bit. Typically, the energy required to break the rock is generated by a hydraulically driven piston that contacts the end of the drill string (via a shank adaptor) to create a stress (or shock) wave that propagates through the drill string to a drill bit. Conventional threaded joints are described in U.S. Pat. Nos. 4,332,502; 4,398,756; 4,687,368 and DE 2800887.

Threaded joints in the percussive drilling tool, such as those between drill string rods and between the endmost drill string rod and the drill bit are subjected to bending forces during drilling from the stress waves that propagate the drill string. These bending moments fatigue the threaded joints and lead to breakage within the threaded portion of the joint. Eventually the stress will cause the threaded joint to get worn out and eventually fail.

Therefore, it is desirable to reduce the stress in the threaded joint to improve the performance of the percussive drilling tool and reduce the risk of the failure in the threaded joint. One solution to reducing stresses in the threaded joint is to increase the diameter of the male thread, however the problem with this is that it weakens the female part of the threaded joint meaning it is more likely to break. Consequently, the problem to be solved is how to decrease stress in the threaded joint to therefore increase its lifetime.

SUMMARY

It is an objective of this invention to provide a novel and improved design for threaded joints for percussive drilling tools. The objective is achieved by providing a female portion to form part of a thread joint for a percussive drilling tool comprising: a mounting sleeve having an axial end, wherein the mounting sleeve surrounds an internal cavity having an axial inner wall at the opposing end of the mounting sleeve compared to the axial end; wherein the mounting sleeve has at least one substantially cylindrical internally threaded section having a length, $L_1$, a thread entrance towards the axial end and a thread exit towards the axial inner wall; wherein the threaded section has a thread form including crests, roots, contact flanks, and non-contact flanks, and having a pitch length, $L_4$, between two axially neighbouring crests and an inner diameter, $D_2$, radially between the roots; a thread clearance section positioned between the axial inner wall and the thread exit having a length $L_2$ and a diameter $D_1$; a guiding section positioned between the thread entrance and the axial end of the sleeve having a length, $L_3$; characterized in that: the pitch length, $L_4$, is between 12.8-14.5 mm. Preferably $L_4$ is between 13.0-13.5 mm.

Advantageously, this reduces the stress in the female portion of the threaded joint, meaning the risk of breakages in the female portion is decreased. Furthermore, if the stress in the female portion is increased then the diameter of the male threaded part can be increased which improves the performance of the percussive drilling tool.

In one embodiment the threaded section has a ratio of $(L_1+L_2+D_2)/L_4>6.2$. Preferably, $(L_1+L_2+D_2)/L_4>6.4$ Advantageously, this reduces the stress in the female portion of the threaded joint, meaning the risk of breakages in the female portion is decreased.

In another embodiment $L_3$-$L_2$ is between 0-12 mm. Advantageously, this reduces the stress in the female portion of the threaded joint, meaning the risk of breakages in the female portion is decreased In another embodiment $L_1$ is between 25-56 mm. Preferably, $L_1$ is between 25-56 mm, more preferably between 30-45 mm. Preferably, the total length of the female thread $(L_1+L_2+L_3)$ is between 70 to 86 mm. Advantageously, this is the most optimal length of threaded section for increased performance.

In one embodiment $L_2/L_1>0.01\times D_1$. Advantageously, by increasing the ratio of the length of the thread clearance area compared to the length of the threaded section means that the stress in thread clearance area decreases.

In one embodiment $L_2/L_1>26\%$, preferably $L_2/L_1>32\%$. Advantageously, increasing the ratio of the length of the thread clearance area compared to the length of the threaded section means that the stress in thread clearance area decreases.

In one embodiment $L_2/L_1<65\%$, preferably $<50\%$. Advantageously, this provides sufficient length in the threaded section to achieve a secure threaded connection.

In one embodiment $L_2/D_1>30\%$, preferably $L_1/D_1>38\%$. Advantageously, increasing the ratio of the length of the thread clearance area compared to the diameter of the threaded section means that the stress in thread clearance area decreases. Therefore, the diameter of the thread clearance and female thread can be increased and consequently so can the diameter of the male part, which leads to increased performance of the male part and less risk of skirt failures in the female part.

In one embodiment $L_2/D_1<65\%$, preferably $<50\%$. Advantageously, this enables a secure threaded connection.

In one embodiment each thread-form has a contact flank angle, $\alpha$, and a non-contact flank angle, $\beta$, inclined relative to a respective baseline located at a respective minor diameter or major diameter thereof, each non-contact flank angle, $\beta$, is greater than the respective contact flank angle, $\alpha$, the crest of each thread-form is inclined from the respective contact flank to the respective non-contact flank such that an apex of the respective thread-form defining the respective major diameter and minor diameter thereof is located adjacent to the respective non-contact flank; wherein each root is a first arc and each contact flank is connected to the respective root by a respective second arc; wherein a first radius of each first arc is greater than a second radius of the respective second arc.

Advantageously, as compared to the prior art discussed above, due to the inclined crests of the thread-forms, the contact flanks become enlarged in response to wear of the couplings. Further, pitting formed in regions adjacent to the contact flanks may be removed as a result of the wear.

In one embodiment the female portion is part of a drill bit.

In one embodiment the female portion is a female end of a drill string rod.

Another aspect of the present invention relates to a drill string rod comprising a female portion as described hereinbefore or hereinafter.

Another aspect of the present invention relates to a drill bit comprising a female portion as described hereinbefore or hereinafter.

BRIEF DESCRIPTION OF THE DRAWINGS

A specific implementation of the present invention will now be described, by way of example only, and with reference to the accompanying drawings.

DETAILED DESCRIPTION

Figure 1:
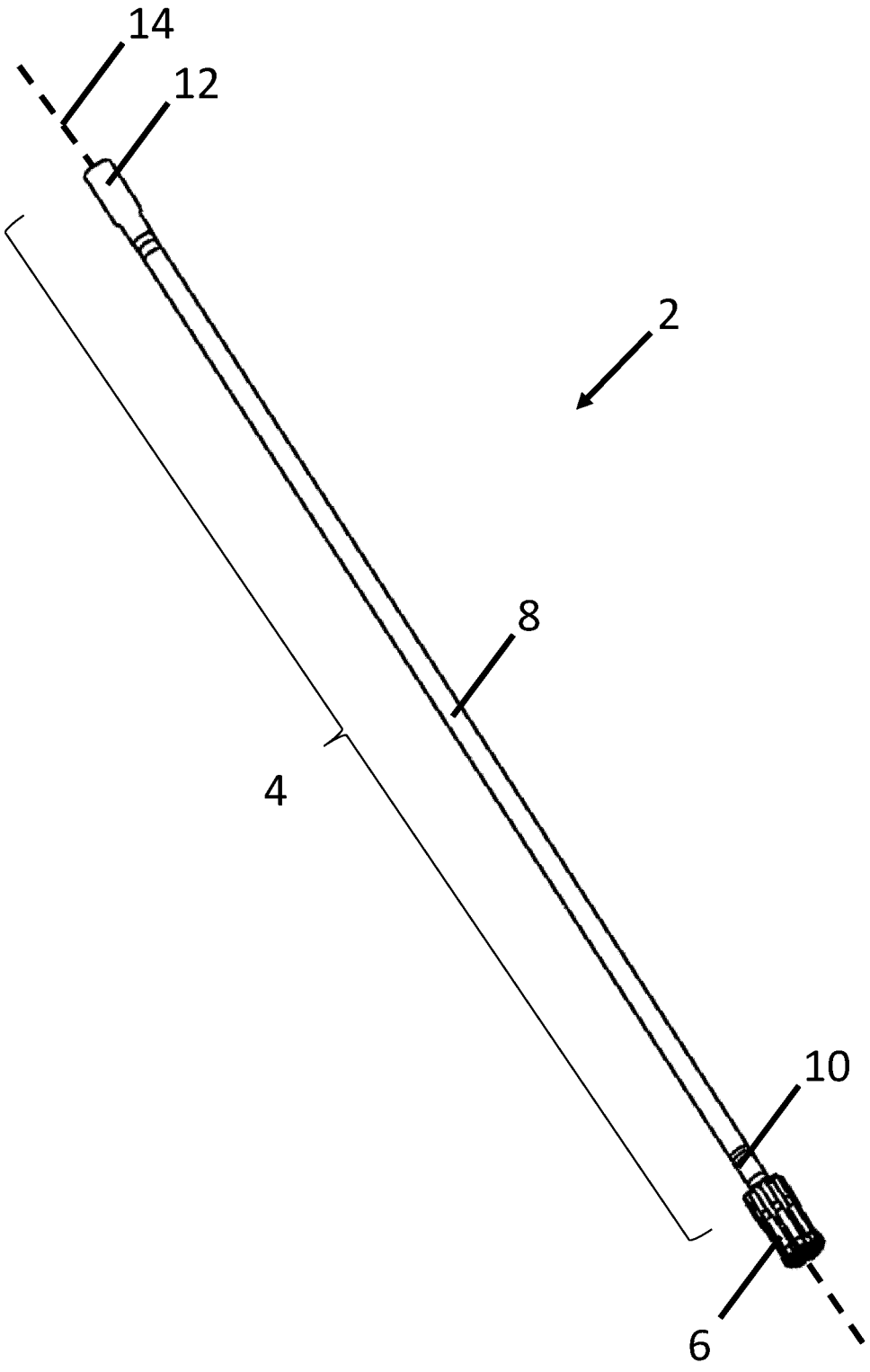
FIG. 1: Perspective view of a percussive drilling tool having one male and one female end.

FIG. 1 shows a percussive drilling tool 2 whereby a drill rod 4 is threadedly coupled to a drill bit 6 of conventional design. The percussive drilling tool 2 is especially used for top hammer drilling. Shockwaves generated by a surface piston (not shown) are translated through the mated surfaces from the drill rod 4 to the drill bit 6. The drill rod 4 comprises an axially extending main length section 8 that is terminated at one end by a male end 10 and at a second opposite end by a female end 12 having a longitudinal axis 14. The drill rod 4 is capable of being coupled end-to-end with other further drill rods to form a drill string (not shown) via another thread joint.

Figure 2:
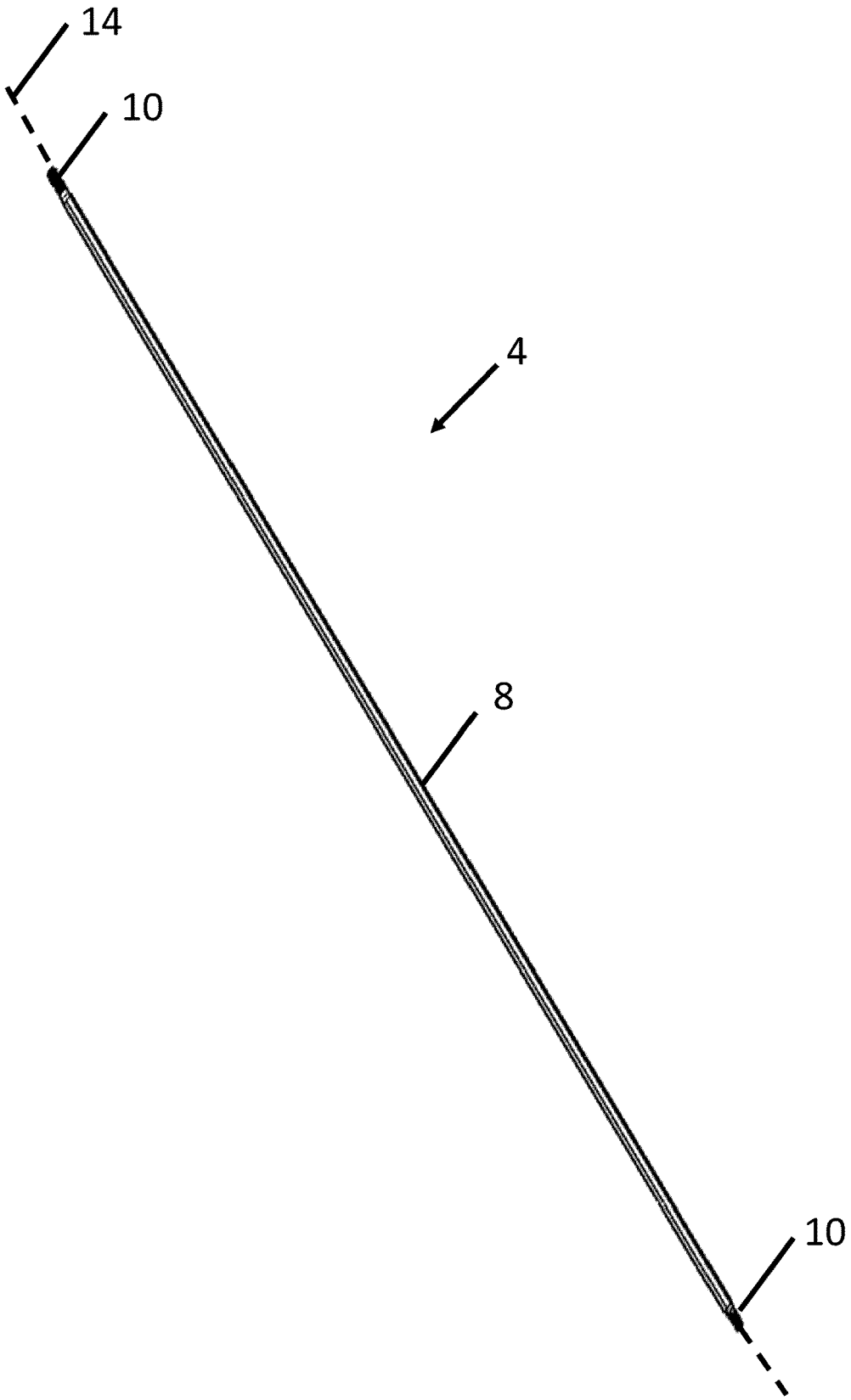
FIG. 2: Perspective view of a drill rod having two male ends.

FIG. 2 shows that alternatively the drill bit 6 may be connected to a single drill rod 4 having two male ends 10.

Figure 3:
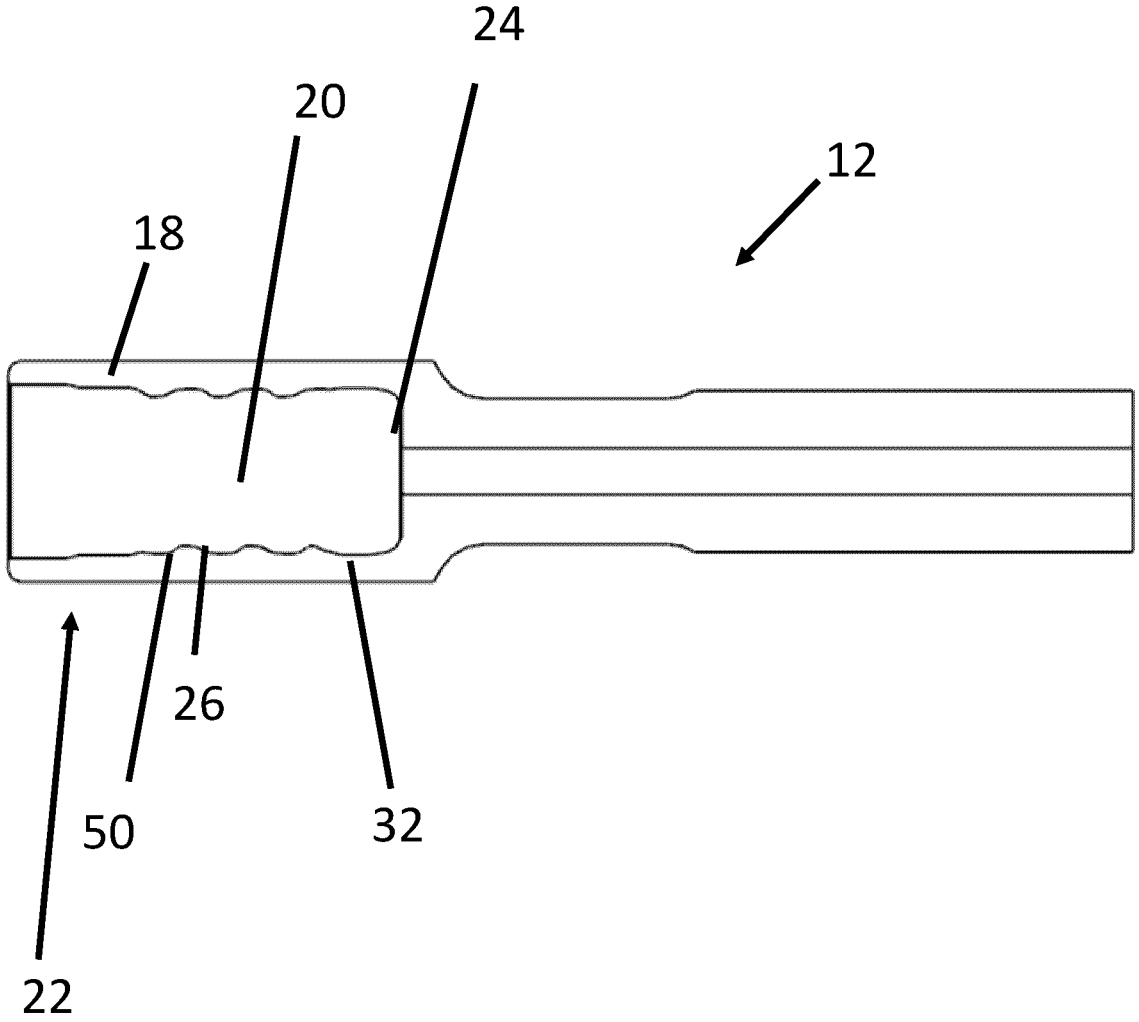
FIG. 3: Cross section of the female end of a drill rod.

FIG. 3 shows a cross section of the female end 12 of the drill rod 4 having a mounting sleeve 18 and an internal cavity 20, which is a hollow space, for receiving the male end 10 of the drill rod 4.

Figure 4:
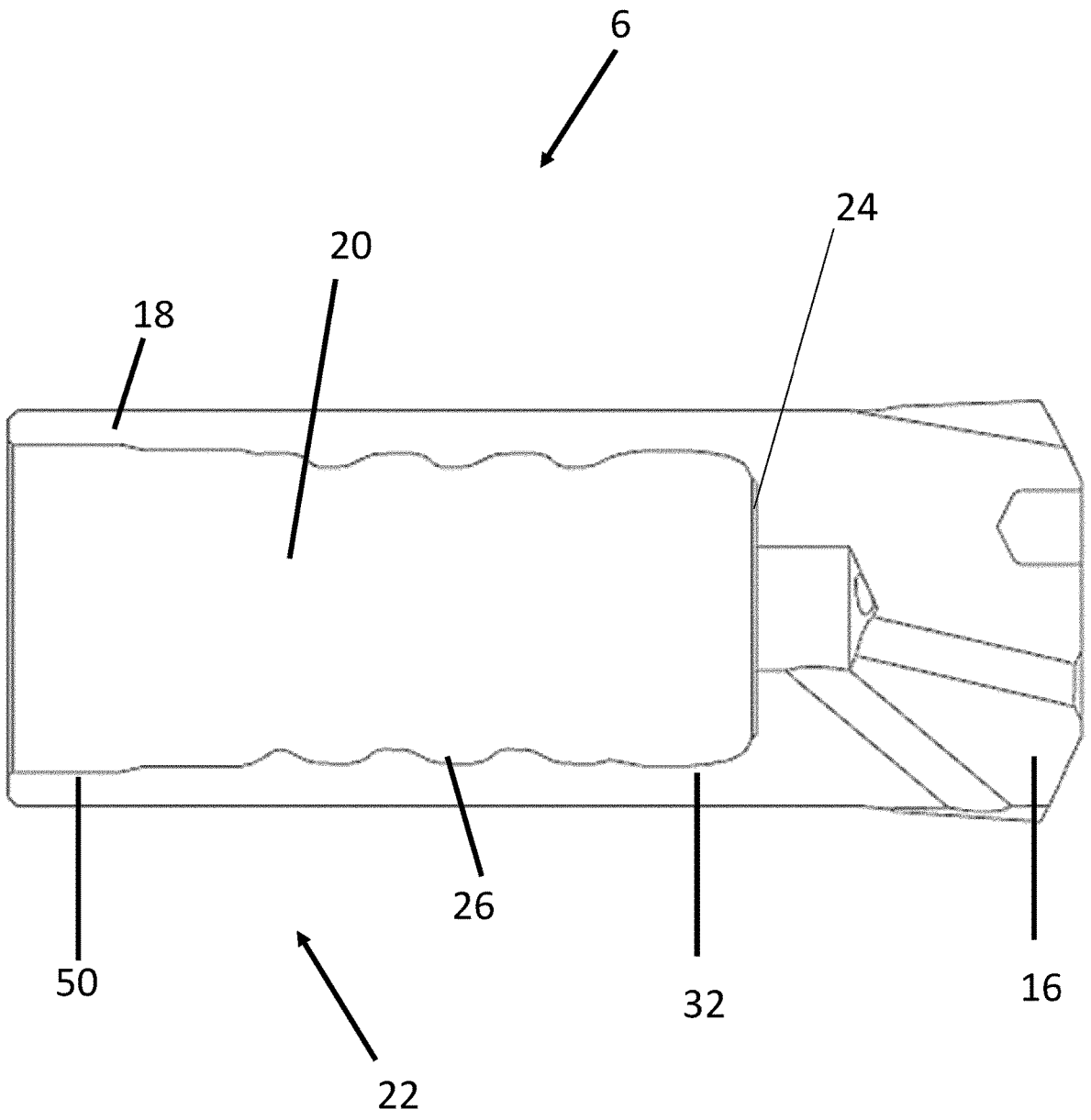
FIG. 4: Cross section of a drill bit.

FIG. 4 shows a cross section of the drill bit 6 comprising an axially forwardmost drill head 16 of convention design for example comprising a rock crushing means, most typically this is a plurality of wear resistant cutting buttons projecting axially forward from the drill head (not shown); a mounting sleeve 18 that comprises an axially extending internal cavity 20 for receiving the male end 10 of the drill rod 4.

The present invention relates to a special design for a female portion 22 and specifically the thread form 54 that forms part of a thread joint for a percussive drilling tool 2. The female portion 22 could be either the female end 12 on the drill rod 4 or the drill bit 6.

Figure 5:
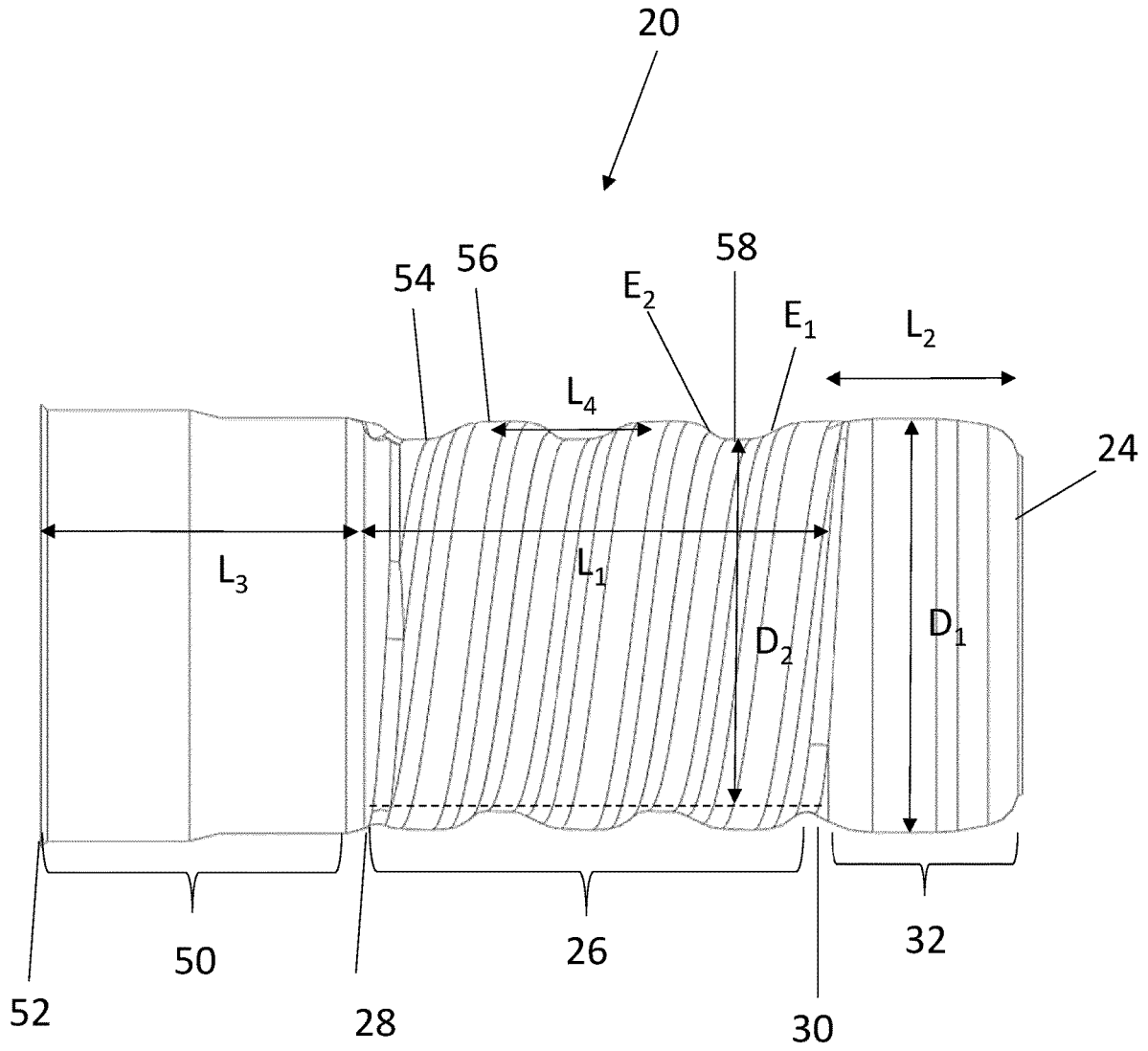
FIG. 5: Cross section of an internal profile of the cavity of the female portion to form part of a thread joint for a percussive drilling tool.

FIG. 5 shows a cross section of an internal profile of the cavity 20 of the female portion 22, in other words FIG. 5 is an enlargement of the interior of FIG. 3 or FIG. 4. The cavity 20 has an axial inner wall 24 for abutment with a male end 10 of a drill rod 4. Further, the cavity 20 has at least one substantially cylindrical internally threaded section 26 having a thread entrance 28 at the axially opposite end compared to the axial inner wall 24 and a thread exit 30 nearer to the axial inner wall 24. The threaded section 26 has a length, $L_1$, which is defined as the length between the thread entrance 28 and the thread exit 30. The threaded section 26 has a thread form 54 comprises a plurality of crests 56, roots 58, contact flanks $E_1$, and non-contact flanks $E_2$, having a pitch length, $L_4$, which is defined as the length between two axially neighbouring crests 56. The threaded section 26 also has an inner diameter, $D_2$, radially between the roots 58.

The cavity 20 of the female portion 22 also has a thread clearance section 32 positioned between the axial inner wall 24 and the threaded section 26. The thread clearance section 32 is circumferential concave recess. The thread clearance section 32 has a length, $L_2$, which is defined as the length between the thread exit 30 and the axial inner wall 24. The thread clearance section has a diameter, $D_1$. There is a guiding section 50 on the opposing end of the threaded section 26 compared to the thread clearance section 32 for guiding the male end 10 of the rod 4 into the correct position. The guiding section 50 has a length, $L_3$, which is defined as the length between the thread entrance 28 and an axial end 52 of the sleeve 18. The guiding section 50 can either be a constant diameter across the whole of the guiding section 50 or it could optionally be stepped so that it has at least two different diameters.

Preferably, $L_3-L_2$ is <12 mm, more preferably <11.5 mm, even more preferably <11 mm. Preferably, $L_3-L_2$ is >0 mm, more preferably >5 mm, even more preferably >7 mm. In one embodiment $L_1$ is between 25-56 mm, more preferably between 30-45 mm.

In one embodiment $L_2/L_1>0.01\times D_1$.

In one embodiment $L_2/L_1>26\%$, more preferably >32%.

In one embodiment $L_2/L_1<65\%$, more preferably <50%.

In one embodiment $L_2/D_1>30\%$, more preferably >38%.

In one embodiment $L_2/D_1<65\%$, more preferably <50%.

Preferably, the female portion 22 is used for forming a thread joint for a percussive drilling tool 2 wherein there is a bottom contact, as opposed to a shoulder contact, between female portion 22 and the male end 10 of the adjoining rod. In other words, there is contact between the axial inner wall 24 on the female portion 22 and the male end 10 of the adjoining rod 4.

Figure 6:
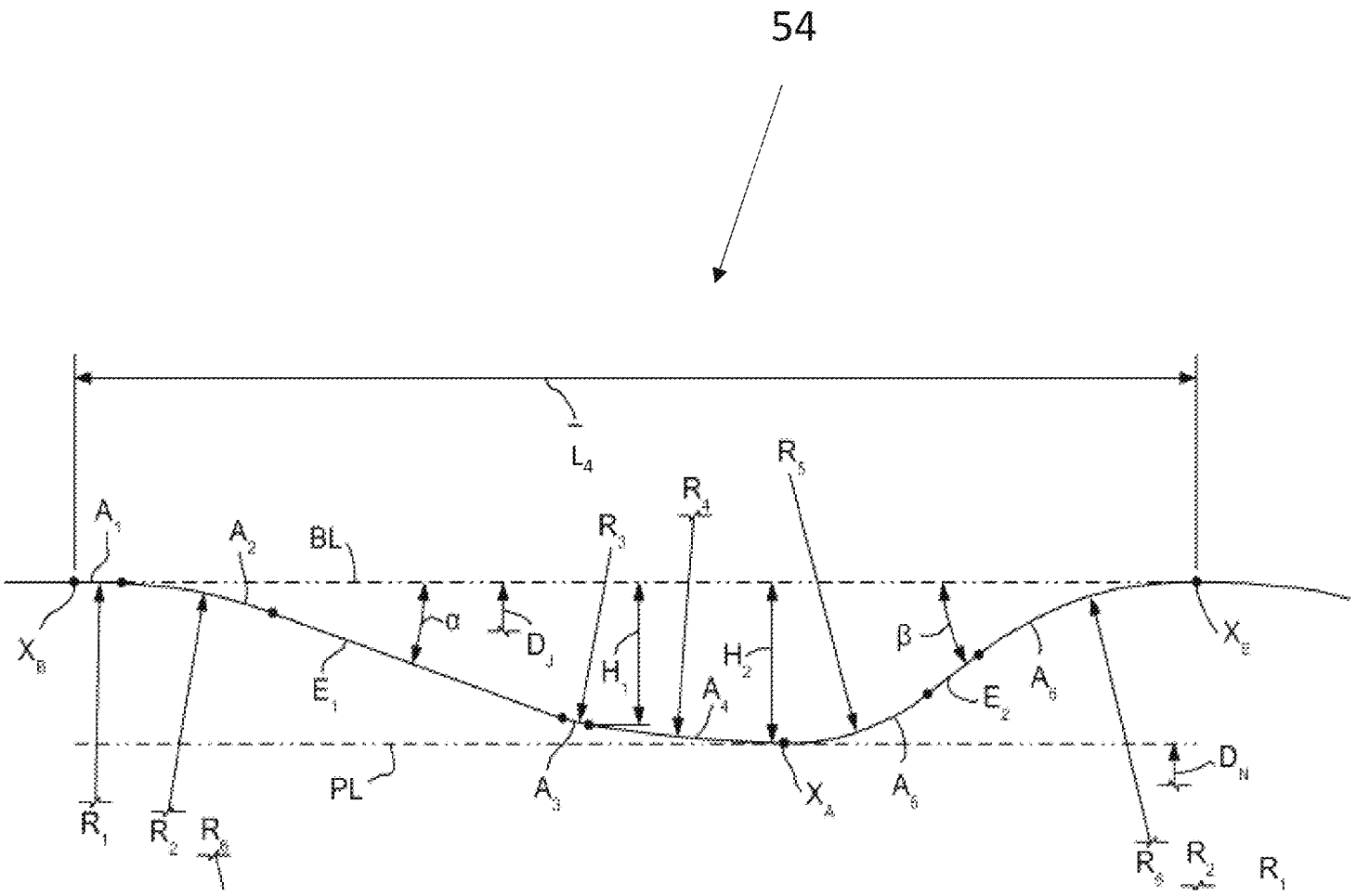
FIG. 6: Illustration of the thread form.

FIG. 6 illustrates the thread form 54. Each thread form 54 may start at point $X_B$ and may include a root $A_1$. Each root $A_1$ may be a concave arc with a respective radius $R_1$ and may extend to a respective second arc $A_2$. Each second arc $A_2$ may be concave, have a respective radius $R_2$, and may extend from the respective first crest $A_1$ to a respective contact flank $E_1$. Each root radius $R_1$ may be greater than the respective second radius $R_2$, such as at least fifty percent greater than the respective second radius. Each contact flank $E_1$ may be a straight line inclined at a respective first flank angle $\alpha$ relative to a respective baseline BL. The baseline BL may be longitudinal and be located at a respective major diameter $D_J$ or minor diameter $D_N$ of the respective thread form 54. Each first flank angle $\alpha$ may range between 15 and 50 degrees. Each contact flank $E_1$ may extend from the respective second arc $A_2$ to a respective third arc $A_3$. Each third arc $A_3$ may be convex and have a respective radius $R_3$. Each third arc $A_3$ may extend from the respective contact flank $E_1$ to a respective crest $A_4$. Each crest $A_4$ may have a respective first height $H_1$ adjacent to the respective third arc $A_3$ and a respective second height $H_2$ adjacent to a respective fifth arc $A_5$. Each height $H_1$, $H_2$ may be measured from the respective baseline BL. Each crest $A_4$ may be inclined from the respective contact flank $E_1$ to the respective non-contact flank $E_2$ such that a respective apex $X_A$ of the respective thread-form 54 defining the respective major diameter $D_J$ or minor diameter $D_N$ is located adjacent to the respective non-contact flank. Each thread-form 54 may have a respective peak line $P_L$ which may be longitudinal and be located at the respective major diameter $D_J$ or minor diameter $D_N$ of the respective thread form 54. Each diameter $D_N$, $D_J$ of the respective thread form 54 may be constant. Due to the inclination of each crest $A_4$, the respective second height $H_2$ may be greater than the respective first height $H_1$. Each inclination may be accomplished by the respective crest $A_4$ being a convex arc with a respective radius $R_4$. Each crest radius $R_4$ may be greater than ten percent of the outer diameter of the male coupling 1. Each crest $A_4$ may extend from the respective third arc $A_3$ to a respective fifth arc $A_5$. Each second height $H_2$ may be 5 to 20 percent greater than the respective first height $H_1$. Alternatively, each crest $A_4$ may be linearly inclined. Each fifth arc $A_5$ may be convex, may have a respective radius $R_5$, and may extend from the respective crest $A_4$ to a respective non-contact flank $E_2$. Each non-contact flank $E_2$ may be a straight line inclined at a respective second flank angle β relative to the respective baseline BL. Each second flank angle β may be greater than the respective first flank angle α, such as 5 to 30 degrees greater than the respective first flank angle, thereby resulting in a respective asymmetric thread-form 54. Each non-contact flank $E_2$ may extend from the respective fifth arc $A_5$ to a respective sixth arc $A_6$. Each sixth arc $A_6$ may extend from the respective non-contact flank $E_2$ to a respective end point $X_E$. Each sixth arc $A_6$ may be concave and have a respective radius $R_6$. Each thread-form 54 may have a respective pitch, $L_4$, defined by a longitudinal distance between the respective start point $X_B$ and the respective end point $X_E$.

In one embodiment each contact flank angle, a, ranges between 15 and 50 degrees and each non-contact flank angle, β equals the respective contact flank angle plus 5 to 30 degrees.

In one embodiment the inclination of each crest 56 is linear.

In one embodiment a height, $H_2$, of each crest 56 adjacent to the respective non-contact flank 62 is 5%-20% greater than a height, $H_1$, of the respective crest 56 adjacent to the respective contact flank 60.

In one embodiment non-contact flank 62 is connected to the respective crest by a respective arc, $A_5$.

In one embodiment each diameter, $D_J$, $D_N$, is constant.

Figure 7:
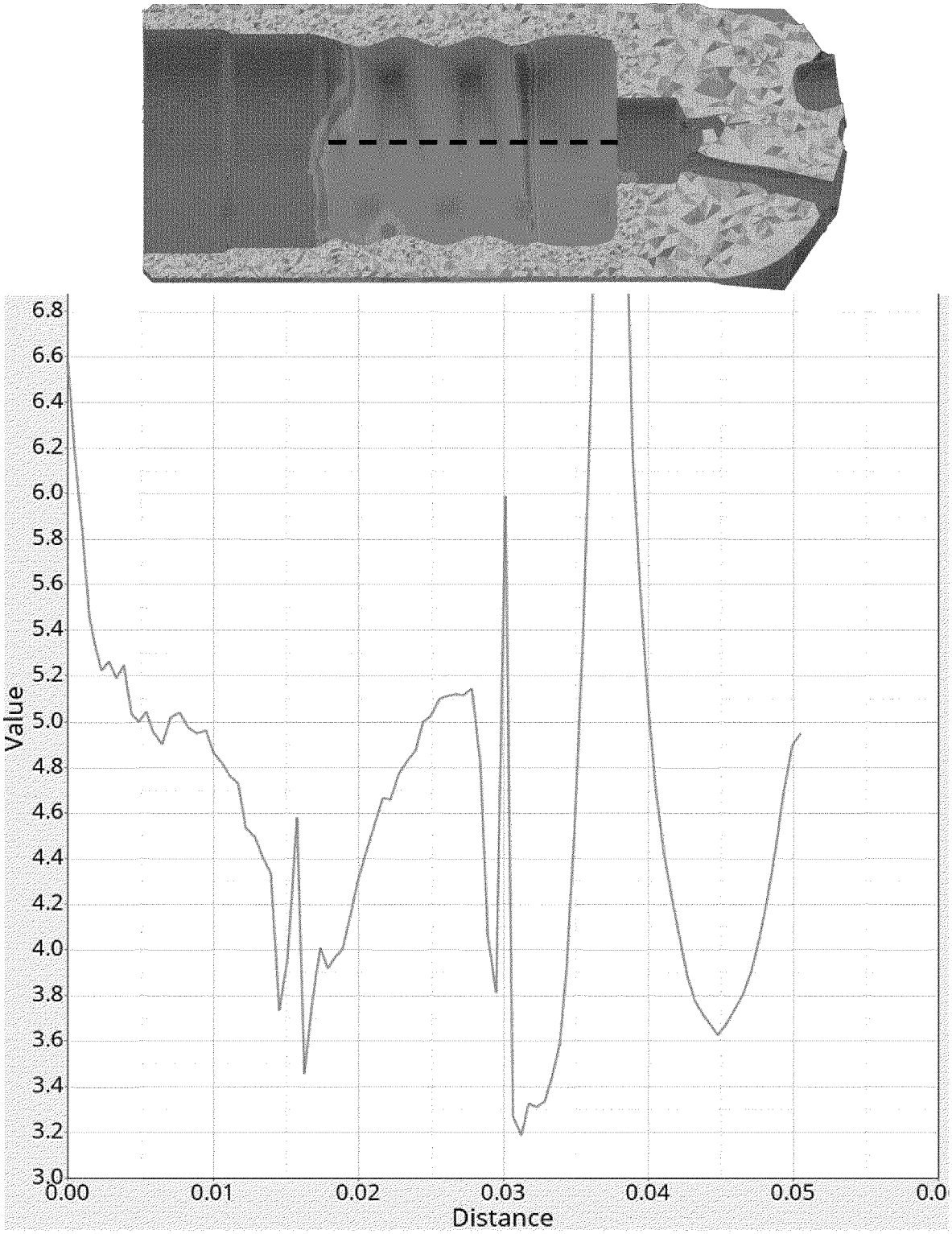
FIG. 7: Safety factor plot of a comparative thread form.
Figure 8:
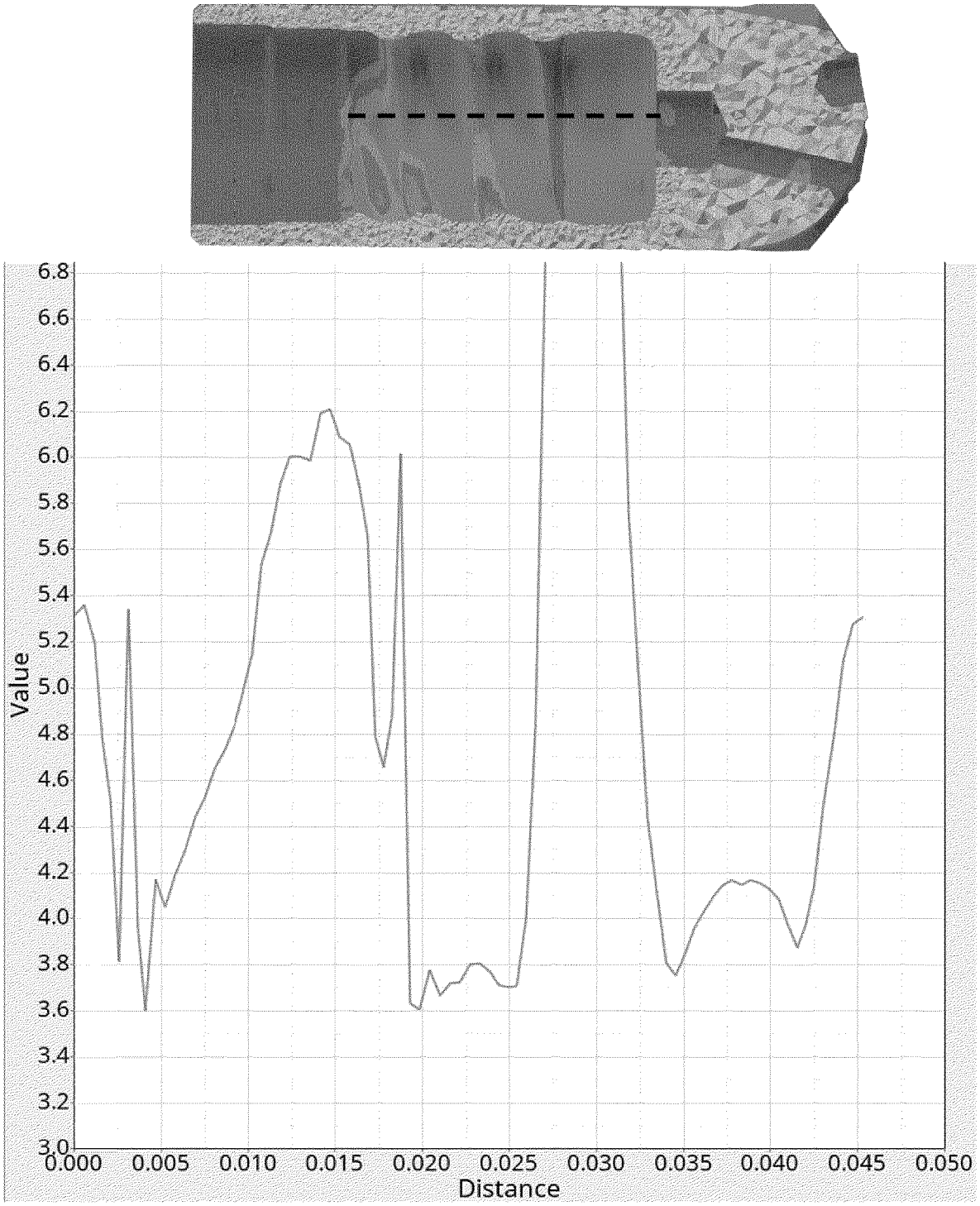
FIG. 8: Safety factor plot of an inventive thread form.

FIGS. 7 and 8 show safety factor plots for a symmetrical thread profile having a pitch, $L_4$, of 12.7 mm (comparative sample) and an asymmetrical thread profile having a pitch, $L_4$, of 13.2 mm (inventive sample) respectfully measured along the dotted line shown in the figures when bending force is applied. Higher safety factor values are an indication that there is a reduced risk of breakage. It can be seen that the inventive sample with the increased pitch length has a reduced risk of breakage along the length of the thread profile.

The invention claimed is:

1. A female portion arranged to form part of a thread joint for a percussive drilling tool, the female portion comprising:

a mounting sleeve having an axial end and an opposing end opposite the axial end, wherein the mounting sleeve surrounds an internal cavity having an axial inner wall at the opposing end of the mounting sleeve, wherein the mounting sleeve has at least one substantially cylindrical internally threaded section having a length, $L_1$, a thread entrance located towards the axial end and a thread exit located towards the axial inner wall, and wherein the threaded section has a thread form including crests, roots, contact flanks, and non-contact flanks, and having a pitch length, $L_4$, disposed between two axially neighbouring crests and an inner diameter, $D_2$, located radially between the roots;

a thread clearance section positioned between the axial inner wall and the thread exit, the thread clearance section having a length $L_2$ and a diameter $D_1$; and a guiding section positioned between the thread entrance and the axial end of the sleeve, the guiding section having a length, $L_3$, wherein the pitch length, $L_4$, is between 12.8-14.5 mm and wherein the threaded section has a ratio of $(L_1+L_2+D_2)/L_4>6.2$.

2. The female portion according to claim 1, wherein $L_3$-$L_2$ is between 0-12 mm.

3. The female portion according to claim 1, wherein $L_1$ is between 25-56 mm.

4. The female portion according to claim 1, wherein $L_2/L_1>0.01\times D_1$.

5. The female portion according to claim 1, wherein $L_2/L_1>26\%$.

6. The female portion according to claim 1, wherein $L_2/L_1<65\%$.

7. The female portion according to claim 1, wherein $L_2/D_1>30\%$.

8. The female portion according to claim 1, wherein $L_2/D_1<65\%$.

9. The female portion according to claim 1, wherein each thread-form has a contact flank angle and a non-contact flank angle inclined relative to a respective baseline located at a respective minor diameter or major diameter thereof, wherein each non-contact flank angle is greater than a respective contact flank angle, wherein the crest of each thread-form is inclined from a respective contact flank to a respective non-contact flank such that an apex of a respective thread-form defining a respective major diameter and minor diameter thereof is located adjacent to the respective non-contact flank, wherein each root is a first arc and each contact flank is connected to a respective root by a respective second arc, and wherein a first radius of each first arc is greater than a second radius of the respective second arc.

10. The female portion according to claim 1, wherein the female portion is part of a drill bit.

11. The female portion according to claim 1, wherein the female portion is a female end of a drill string rod.

12. A drill string rod comprising a female portion according to claim 1.

13. A drill bit comprising a female portion according to claim 1.

* * * * *